US010923838B2

(12) United States Patent
Markgraf

(10) Patent No.: US 10,923,838 B2
(45) Date of Patent: Feb. 16, 2021

(54) CONNECTING TERMINAL AND ELECTRICAL APPARATUS

(71) Applicant: NEXANS, Courbevoie (FR)

(72) Inventor: Volker Markgraf, Roslau (DE)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/555,440

(22) Filed: Aug. 29, 2019

(65) Prior Publication Data

US 2020/0099146 A1 Mar. 26, 2020

(30) Foreign Application Priority Data

Sep. 3, 2018 (EP) ..... 18306158

(51) Int. Cl.

| | |
|---|---|
| ***H01R 12/00*** | (2006.01) |
| ***H01R 11/05*** | (2006.01) |
| ***H01R 4/30*** | (2006.01) |
| ***H01R 4/36*** | (2006.01) |
| ***H01R 4/56*** | (2006.01) |

(52) U.S. Cl.

CPC ..... *H01R 11/05* (2013.01); *H01R 4/304* (2013.01); *H01R 4/36* (2013.01); *H01R 4/56* (2013.01)

(58) Field of Classification Search

CPC ..... H01R 11/05; H01R 4/304; H01R 4/36; H01R 4/56; H01R 31/02; H01R 4/305; H01R 9/2416

USPC ..... 439/431

See application file for complete search history.

(56) References Cited

U.S. PATENT DOCUMENTS

| | | | | |
|---|---|---|---|---|
| 4,213,669 | A * | 7/1980 | Wittes | H01R 4/36 439/811 |
| 7,229,325 | B1 * | 6/2007 | Flynn | H01R 9/223 439/798 |
| 8,277,263 | B1 * | 10/2012 | Smith | H01R 4/32 439/779 |
| 2009/0163087 | A1 * | 6/2009 | Sweeney | H01R 4/26 439/798 |
| 2009/0176416 | A1 * | 7/2009 | Flynn | H01R 13/5216 439/814 |
| 2011/0237140 | A1 | 9/2011 | Cerasale | |
| 2013/0295790 | A1 * | 11/2013 | Cornelius | H01R 13/64 439/359 |
| 2014/0162486 | A1 * | 6/2014 | Yasui | H01R 4/305 439/359 |

(Continued)

FOREIGN PATENT DOCUMENTS

GB 1422935 1/1976

OTHER PUBLICATIONS

International Search Report dated Jan. 18, 2019.

*Primary Examiner* — Abdullah A Riyami
*Assistant Examiner* — Nelson R. Burgos-Guntin
(74) *Attorney, Agent, or Firm* — Sofer & Haroun, LLP

(57) ABSTRACT

A terminal for connecting a conductor (301,302) to a connector pin (101) of an electrical apparatus. The connector pin (101) is provided with an external thread. The terminal has a first central and a second central threaded hole (111, 112), which intersect perpendicularly. The internal threads of the threaded holes (111,112) match the external thread of the connector pin (101), so that the terminal is screwable in two different orientations onto the connector pin (101). The terminal has one or more conductor channels for the connection of leads (301,302).

7 Claims, 3 Drawing Sheets

(56) References Cited

U.S. PATENT DOCUMENTS

| | | | | |
|---|---|---|---|---|
| 2015/0087171 | A1* | 3/2015 | Siebens | H01R 4/646<br>439/108 |
| 2015/0303595 | A1* | 10/2015 | Wu | H01H 71/08<br>439/709 |
| 2016/0013603 | A1* | 1/2016 | Hui | H01R 39/00<br>439/13 |
| 2016/0028170 | A1* | 1/2016 | Hyder | H01R 4/4845<br>439/462 |
| 2018/0006399 | A1 | 1/2018 | McLemore et al. | |
| 2020/0099146 | A1* | 3/2020 | Markgraf | H01R 9/2416 |

* cited by examiner

CONNECTING TERMINAL AND ELECTRICAL APPARATUS

RELATED APPLICATION

This application claims the benefit of priority from European Patent Application No. 18 306 158.9, filed on Sep. 3, 2018, the entirety of which is incorporated by reference.

FIELD

The invention relates to a terminal for connecting a conductor to a connector, in particular to a connector pin of an electrical apparatus, for example a transformer. The invention further relates to an electrical apparatus having a connector pin on which a terminal according to the invention is screwed.

BACKGROUND

Electrical apparatuses, such as, for example, transformers, which are used in electrical supply networks frequently have connector pins to which electrical leads are connected, wherein the connector pins are in many cases configured as threaded pins. In concrete terms, such connector pins can be found, for instance, on the low-voltage side of transformers. Electrical leads are often connected with screw terminals to the connector pins.

From DE 2 228 088 A1, a terminal for connecting a conductor to a connector pin of a transformer is known. The terminal is here configured such that the leads are led away at right angles in relation to the longitudinal axis of the connector pin. That is to say, in a connector pin which is oriented in the vertical direction, the leads are led away in the horizontal direction. If in specific applications, however, it is necessary to connect the leads parallelly to the connector pin, another type of connecting terminal is required. This means that at least two different types of terminals must be stocked.

Based on the above, an object of the present invention is to provide an alternative terminal which, in relation to previously known terminals, is more flexible to use in order to overcome, or at least alleviate, one or more of the problems stated in the introduction.

SUMMARY OF THE INVENTION

For the achievement of this object, the invention proposes, according to a first aspect, a terminal for connecting a conductor to a connector pin of an electrical apparatus, which connector pin is provided with an external thread. The terminal is distinguished by the fact that the terminal has a first and a second threaded hole, which intersect perpendicularly. The internal threads of the first and second threaded hole match the external thread of the connector pin. The terminal is therefore screwable in two different orientations onto the connector pin. The terminal has a conductor channel along an axis which is parallel to an axial direction of the first threaded hole. The terminal has a further threaded hole for receiving a pressure screw, which threaded hole opens out into the conductor channel. The threaded hole is oriented perpendicular to the axis of the conductor channel.

The structure of the terminal makes it possible to connect one or more conductors in two different orientations in relation to the longitudinal axis of the connector pin. The terminal is therefore suitable for different installation positions, so that to need to stock different terminals for different installation positions is eliminated. During assembly, the threaded hole into which the connector pin is not screwed allows an inspection of the correct mounting of the terminal on the connector pin. Once the terminal is fixed with a pressure screw on the connector pin, the free threaded hole can be used for the fitting of a further connector pin, for example for a ball pin.

In one illustrative embodiment, the terminal has a second pressure screw, which is screwed into the same threaded hole as the connector pin, but in opposite direction to the connector pin. This pressure screw clamps the terminal on the connector pin without still further means being necessary for this purpose, in particular no second pressure screw is necessary for this.

In an advantageous embodiment of the terminal, the conductor channel has grooves and/or projections. The structured inner surface of the conductor channel generates at certain points a high contact pressure for a conductor received into the conductor channel, so that any oxide layers which might be present on the surface of the conductor are broken up and a good electrical contact is produced.

Advantageously, a plurality of conductor channels, in particular two parallel conductor channels, are provided in the terminal. A higher number of conductor channels allows a corresponding number of leads to be connected with the terminal.

In a preferred embodiment of the terminal, the conductor channels are arranged to the left and right of one of the two threaded holes. This embodiment has proved particularly space-saving and expedient in terms of the assembly.

Advantageously, the first and the second threaded hole, which intersect perpendicularly, can respectively be arranged in the middle of a main surface of a terminal body of the terminal. This embodiment enables a symmetrical mounting of the terminal on the connector pin.

According to a second aspect, the invention proposes an electrical apparatus having a connector pin on which a terminal according to the first aspect of the invention is screwed. The electrical apparatus is, for instance, a transformer, in particular the low-voltage side of a transformer.

BRIEF DESCRIPTION OF THE DRAWINGS

Below, the invention is explained in greater detail, by way of example, on the basis of one embodiment, with reference to the accompanying figures. All figures are purely schematic and not true-to-scale, wherein.

Same or similar elements are provided in the figures with same or similar reference symbols.

DETAILED DESCRIPTION

Figure 1:
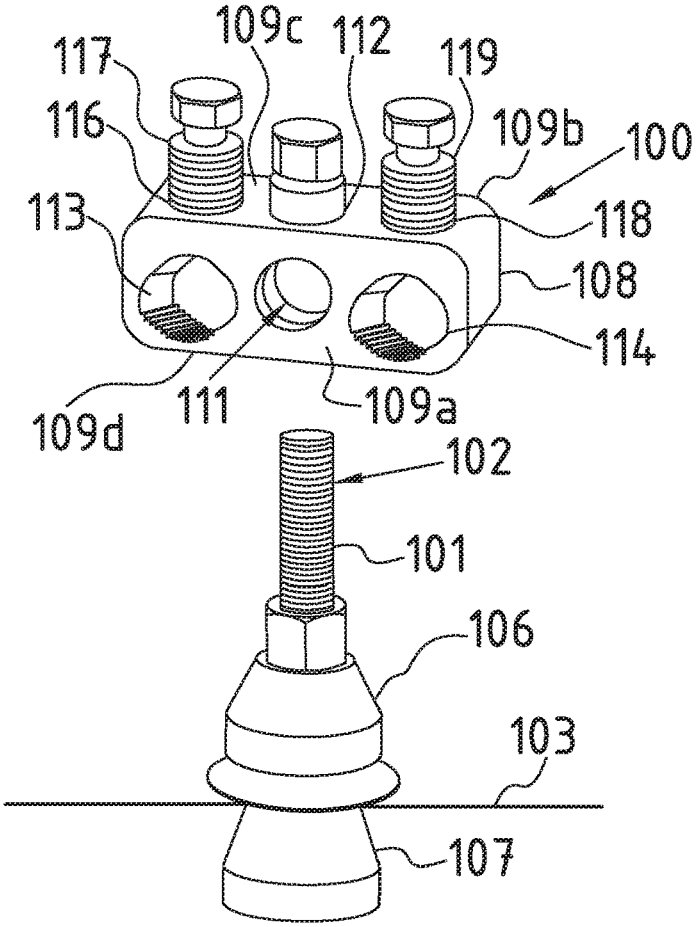
FIG. 1 shows a perspective view of a terminal according to the invention and a connector pin.

FIG. 1 shows in a perspective view an illustrative embodiment of a terminal according to the invention, which terminal is denoted in its entirety by the reference symbol 100. In FIG. 1, beneath the terminal 100 is represented a connector pin 101 for an electrical apparatus, which connector pin is provided with an external thread 102. Of the electrical apparatus, only a part of a housing 103 is shown, and indicated schematically with a line. The connector pin 101 is guided through the housing 103 and insulated against the housing 103 with insulators 106,107. In a concrete illustrative embodiment, the electrical apparatus is a transformer and the housing 103, accordingly the transformer housing. In particular, a concrete illustrative embodiment can be constituted by the low-voltage side of a transformer which is equipped with bushings according to DIN EN 50386. However, the invention is not restricted to this type of connector pin, but rather is also applicable to other varieties of threaded pins to which electrical leads are intended to be connected.

During operation of the transformer, it is necessary to connect electrical leads to the connector pin 101. This is generally realized with screw terminals, which establish an electrical contact with low contact resistance and high current-carrying capacity between the connector pin and the leads to be connected.

The proposed terminal 100 has a terminal body 108, which is of substantially cuboid configuration. The terminal body 108 hence comprises a first main surface 109*a* and an opposite second main surface 109*b*. The terminal body 108 further has a third main surface 109*c*, which in FIG. 1 lies at the top, and a fourth main surface 109*d*, which lies opposite the third main surface 109*c*.

A first threaded hole 111*s* arranged centrally in the first main surface 109*a* reaches from the first main surface 109*a* to the second main surface 109*b*. A second threaded hole 112 reaches from the third main surface 109*c* to the fourth main surface 109*d* and is likewise arranged centrally in the middle of the third and fourth main surface respectively. Hence the first and the second threaded hole 111,112 intersect in the centre of the terminal body 108. The internal threads of the threaded holes 111,112 match the external thread 102 of the connector pin 101.

To both sides of the first threaded hole are respectively arranged a continuous first and second conductor channel 113, 114. The conductor channels 113 and 114 thus extend from the first main surface 109*a* to the second main surface 109*b*. In the third main surface 109*c* is provided a threaded hole 116, which opens out into the first conductor channel 113 and which receives a pressure screw 117. With the pressure screw 117, it is consequently possible to clamp in the terminal body 108 a conductor which has been introduced into the conductor channel 113. Correspondingly, in the third main surface 109*c* is provided a threaded hole 118, which opens out into the second conductor channel 114 and which receives a pressure screw 119, with which a conductor inserted into the conductor channel 114 can be clamped in the terminal body 108.

In the second central threaded hole 112 is screwed a further pressure screw 121, the function of which is explained in connection with FIG. 2.

Figure 2:
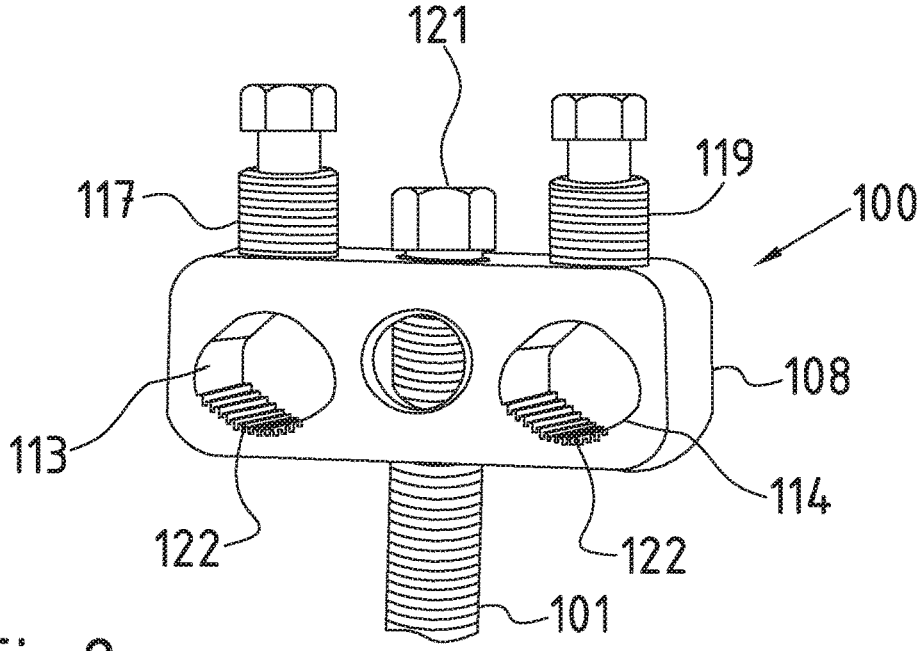
FIG. 2 shows the terminal, screwed onto the connector pin, from FIG. 1.

FIG. 2 shows the terminal 100 screwed onto the connector pin 101. The connector pin 101 is here screwed into the second central threaded hole 112 to the point where the connector pin 101 projects approximately into the middle of the first central threaded hole 111. The pressure screw 121 is screwed from the third main surface 109*c*, towards the connector pin 101, into the second central threaded hole 112, so that the end faces of the connector pin 101 and of the pressure screw 121 are pressed one against the other and hereupon mechanically clamp the terminal body 108 with the connector pin 101 and, at the same time, establish a good electrical contact between terminal body 108 and connector pin 101. In the proposed terminal 100, a single pressure screw 121 is thus sufficient to generate the contact pressure and to obtain a mechanical clamping on the connector pin.

The first central threaded hole 111 here enables a visual inspection by an assembler in order to check whether the terminal 100 is screwed far enough or too far onto the connector pin 101.

The inner sides of the conductor channels 113,114 have a region which is provided with longitudinal ribs 122 as the surface structure. In the illustrative embodiment represented in FIG. 2, the longitudinal ribs 122 have a triangular cross section. In other illustrative embodiments, other cross-sectional shapes too can be chosen. The regions having the surface structure lie in the conductor channels 113,114 on that side which lies opposite the side where the pressure screw 117 or 119 enters into the conductor channel 113 or 114. In the mounting of a conductor, the pressure screw 117 or 119 therefore presses the conductor against the corresponding surface structure made up of the longitudinal ribs 122, which break up any oxide layer which may possibly be present on the conductor and in this way promote the establishment of a good electrical contact. Disturbing insulating oxide layers of such kind arise, for instance, in conductors made of aluminium or aluminium alloys.

Figure 3:
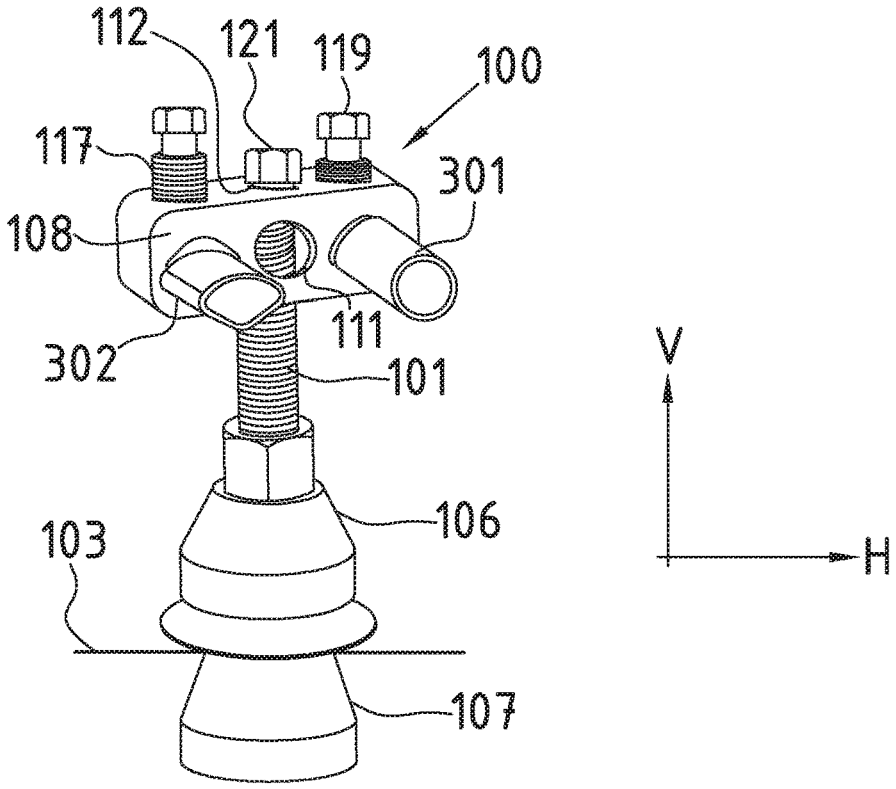
FIG. 3 shows a terminal, screwed into the connector pin, with two conductors connected in the horizontal direction.

In FIG. 3, a perspective view of the terminal 100 mounted on the connector pin 101 is represented. In the terminal 100 are fitted 2 conductors 301 and 302, which are illustrated by short conductor portions. An arrow V indicates in FIG. 3 a vertical direction, whilst an arrow H indicates a horizontal direction. This convention shall apply to all figures. In the represented assembly, the conductor channels 113,114 are oriented in the horizontal direction and thereby allow a simple mounting of horizontally running leads 301,302.

Figure 4:
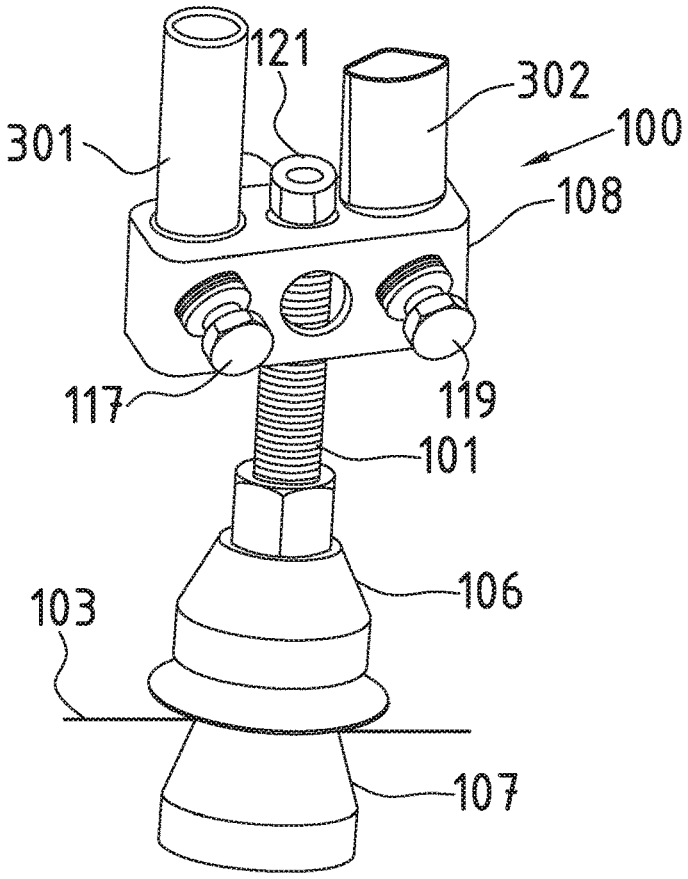
FIG. 4 shows a terminal, screwed onto the connector pin, with two conductors connected in the vertical direction.

In FIG. 4, the terminal 100, in contrast to FIG. 3, is screwed onto the connector pin 101 by means of the first central threaded hole 111, so that the conductor channels extend parallel to the connector pin 101 and hence enable a simple fitting of leads 301, 302 running in the vertical direction. The possible horizontal and vertical connections of the leads 301, 302 are consequently achieved with one and the same terminal 100, which is screwed onto the connector pin only in two different orientations. As a result of the proposed terminal, the need to stock different terminals in order to connect cables in different orientations with respect to the connector pin is eliminated.

Figure 5:
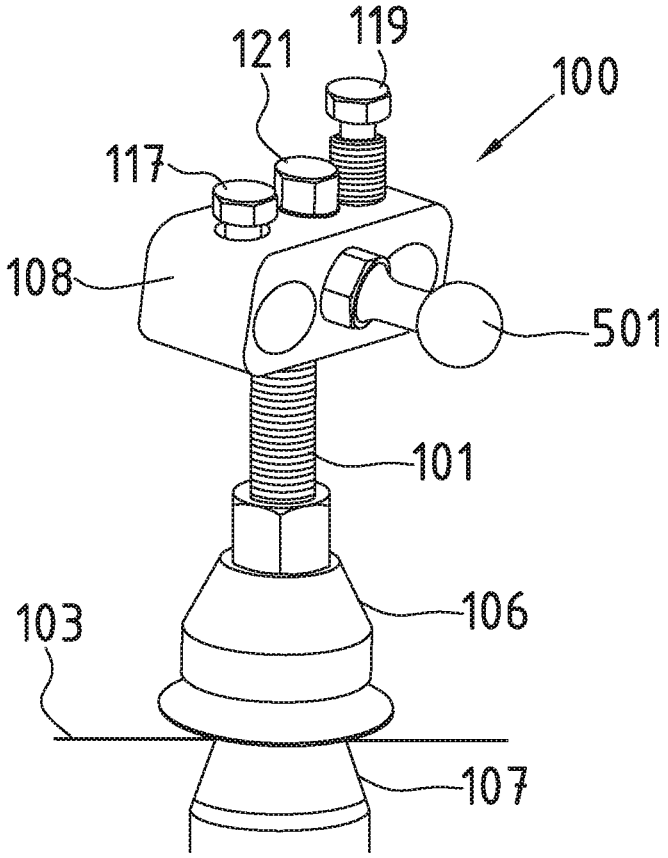
FIG. 5 shows a terminal screwed onto the connector pin, having horizontally oriented conductor channels and having an additional ball pin.

FIG. 5 shows the terminal 100 mounted onto the connector pin 101, wherein the conductor channels 113, 114, as in FIG. 3, are oriented horizontally. In this orientation, the connector pin is screwed into the second central threaded hole 112. In the illustrative embodiment represented in FIG. 5, a ball pin 501 is screwed into the first central threaded hole 111 in order to create further connection options for additional leads.

Figure 6:
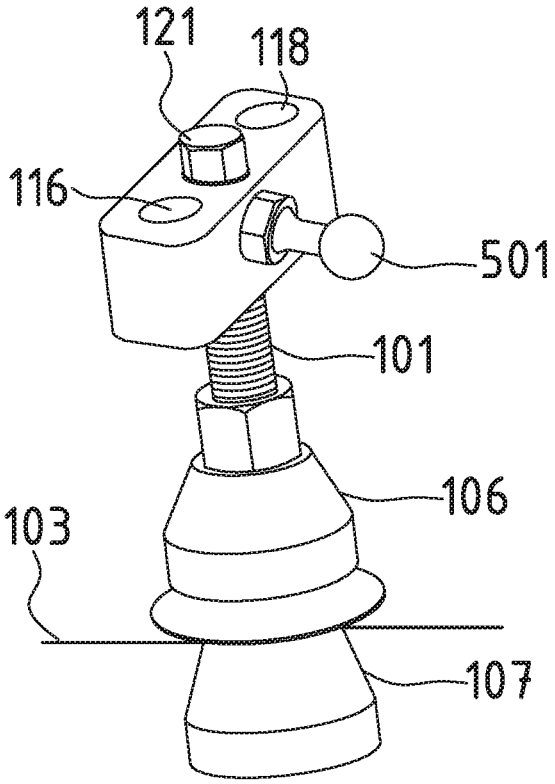
FIG. 6 shows a terminal screwed onto the connector pin, having vertically oriented conductor channels and having an additional ball pin.

FIG. 6 shows the terminal 100 mounted onto the connector pin 101, wherein the conductor channels 113,114, as in FIG. 4, are oriented vertically. In this orientation, the connector pin is screwed into the second central threaded hole 112. In the illustrative embodiment represented in FIG. 6, a ball pin 501 is screwed into the second central threaded hole 111 in order to create further connection options for additional leads.

A comparison between FIGS. 5 and 6 shows that the additional ball pin 501 always has a horizontal orientation if the connector pin has a vertical orientation, because the free central threaded hole is in this case always oriented horizontally.

In the illustrative embodiments represented in the drawing, the pressure screws 117, 119 make direct contact with the connected conductors. In other illustrative embodiments can also, however, movable pressure pieces, which are pressed by the pressure screw onto the conductor in order to establish the electrical contact.

The proposed terminal can be made, for example, of copper, aluminium and alloys thereof, as well as other electrically conductive metals and their alloys.

In a further illustrative embodiment of the terminal, the connected lead is not clamped directly with a pressure screw, but rather, in the terminal, a movable pressure part is provided in the conductor channel. The terminal which is designed in this way, given specific conductor diameters or specific cross-sectional shapes of the conductor, can have advantages over the direct contact with the pressure screw.

REFERENCE SYMBOL LIST

100 terminal
101 connector pin
102 external thread
103 housing
106,107 insulators
108 terminal body
109*a* first main surface
109*b* second main surface
109*c* third main surface
109*d* fourth main surface
111 first central threaded hole
112 second central threaded hole
113 first conductor channel
114 second conductor channel
116 threaded hole
117 pressure screw
118 threaded hold
119 pressure screw
121 pressure screw
122 grooves
301 conductor
302 conductor
501 ball pin

The invention claimed is:

1. Terminal for connecting a conductor to a connector pin of an electrical apparatus, said terminal comprising:

a first and a second threaded hole that both can receive a connector pin having an external thread, wherein the first and second threaded hole intersect perpendicularly and the internal threads of the first and second threaded hold match the external thread of the connector pin, so that the terminal is screwable in two different orientations onto the connector pin, wherein the terminal has a conductor channel for receiving the conductor, wherein the conductor channel extends along an axis which is parallel to an axial direction of the first threaded hole, and wherein the terminal has a further threaded hole, which is oriented perpendicular to the axis of the conductor channel and intersects the conductor channel for receiving a pressure screw.

2. Terminal according to claim 1, wherein the terminal is provided with a second pressure screw, which is screwed into the same threaded hole as the connector pin, but in opposite direction to the connector pin.

3. Terminal according to claim 1, wherein the conductor channel has grooves and/or projections.

4. Terminal according to claim 1, wherein the terminal has a plurality of, in particular two parallel conductor channels.

5. Terminal according to claim 4, wherein the conductor channels are arranged to the left and right of one of the two threaded holes.

6. Terminal according to claim 1, wherein the first and the second threaded hole, which intersect perpendicularly, are respectively arranged in the middle of a main surface of a terminal body of the terminal.

7. Electrical apparatus having a connector pin on which a terminal, according to claim 1, is screwed.

* * * * *